United States Patent [19]

Ickes

[11] 4,042,160

[45] Aug. 16, 1977

[54] FIREPLACE FORM

[76] Inventor: John C. Ickes, 2017 Florida Ave., Joplin, Mo. 64801

[21] Appl. No.: 590,793

[22] Filed: June 27, 1975

Related U.S. Application Data

[63] Continuation-in-part of Ser. No. 516,170, Oct. 21, 1974, abandoned, which is a continuation-in-part of Ser. No. 465,853, May 1, 1974, abandoned.

[51] Int. Cl.[2] ..... F24B 7/00

[52] U.S. Cl. ..... 126/121; 126/131

[58] Field of Search ..... 237/51; 126/120, 121, 126/67, 68, 69, 70, 71, 72, 130, 1

[56] References Cited

U.S. PATENT DOCUMENTS

| | | | |
|---|---|---|---|
| 1,383,506 | 7/1921 | Westerlund | 126/121 |
| 2,117,379 | 5/1938 | Turner | 126/121 |
| 2,832,332 | 4/1958 | Johnson | 126/121 |

FOREIGN PATENT DOCUMENTS

| | | | |
|---|---|---|---|
| 785,699 | 11/1957 | United Kingdom | 126/121 |

*Primary Examiner*—Ronald C. Capossela
*Attorney, Agent, or Firm*—Koenig, Senniger, Powers and Leavitt

[57] ABSTRACT

A fireplace form comprising a firebox having an open front, a back wall, and a pair of side walls extending from the back toward the open front. The back and side walls which at least partially converge in upward direction form a main flue outlet generally at the top of the firebox for communication with a chimney flue. The firebox has at least one aperture therein in its back wall intermediate the bottom of the firebox and the main flue outlet. The fireplace form has ducts on the back side of the firebox in communication with these apertures and the chimney flue, these apertures and ducts constituting auxiliary flues for at least partially ducting away smoke and other products of combustion from the firebox. An outer housing surrounds the firebox and defines a chamber between the firebox and the housing for circulating fresh air over the back side of the firebox and over the ducts so as to be heated for discharge of heated air into a room.

13 Claims, 7 Drawing Figures

FIREPLACE FORM

CROSS-REFERENCE TO RELATED APPLICATIONS

This application is a continuation-in-part of Ser. No. 516,170, filed Oct. 21, 1974 now abandoned, which is a continuation-in-part of application Ser. No. 465,853, filed May 1, 1974 now abandoned.

BACKGROUND OF THE INVENTION

This invention relates to fireplaces, and more particularly to so-called fireplace forms which cause air from within a room to circulate over the back side of the firebox so as to be heated and then to be discharged back into the room.

Known fireplace forms include an enclosure or housing on the outside of and spaced from the sides, back, and top of a firebox so as to define a chamber between the firebox and the enclosure in which fresh air is heated. Typically, the enclosure has air inlets for the intake of air at its bottom and air outlets at its top for discharging the heated air. The outlets are often connected to appropriate air ducts for distribution of the heated air into a room. In many instances, natural convection within the chamber was sufficient to effect the circulation of air therewithin. In other instances, blowers have been utilized to aid in circulating the air. Reference may be made to U.S. Pat. No. 2,642,859 for disclosure of such a fireplace form. Other fireplace forms, such as are disclosed in U.S. Pat. No. 252,064 were intended for use in down-draft fireplaces. Down-draft fireplaces, however, are not widely used in residential fireplaces.

In other known fireplace forms, attempts have been made to increase the heating efficiency of the fireplace by circulating air through so-called "heat flues." Reference may be made to such U.S. Pat. Nos. as 2,165,661, 2,331,178 and 2,549,365 for examples of such fireplace forms with increased heat transfer abilities. Generally, these prior art fireplace forms did increase the thermal efficiency of the fireplace, but still a significant part of, if not the majority of, heat from the fire was wasted.

SUMMARY OF THE INVENTION

Among the several objects of this invention may be noted the provision of a fireplace form which has increased thermal efficiency; the provision of such a fireplace form which has increased heat transfer area for heating of air circulated thereover; the provision of such a fireplace form which may be readily prefabricated for ease of installation and which does not require undue space for installation; the provision of such a fireplace form which requires a minimum of maintenance; the provision of such a fireplace form which circulates air to be heated over the hottest portions of the firebox; and the provision of such a fireplace form which is safe in operation and which draws properly to prevent the smoke from escaping into the room. Other objects and features of this invention will be in part apparent and in part pointed out hereinafter.

Briefly, a fireplace form of this invention comprises a firebox adapted to contain a fire of burning logs or other fuel having an open front, a back wall, and a pair of side walls at opposite sides of the back wall and extending toward the open front. The back and side walls at least partially converge in upward direction to form main flue outlet means generally at the top of the firebox for communication with a chimney flue. The firebox has at least one aperture in its back wall intermediate the bottom of the firebox and the main flue outlet means. The fireplace form further includes duct means on the back side of the firebox in communication with the aperture and with the chimney flue, this aperture and duct means constituting auxiliary flue means for at least partially ducting away smoke and other products of combustion from the firebox. Other means are provided for circulating fresh air over the back side of the firebox and over the duct means so as to be heated and for exhausting this heated air into a room.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
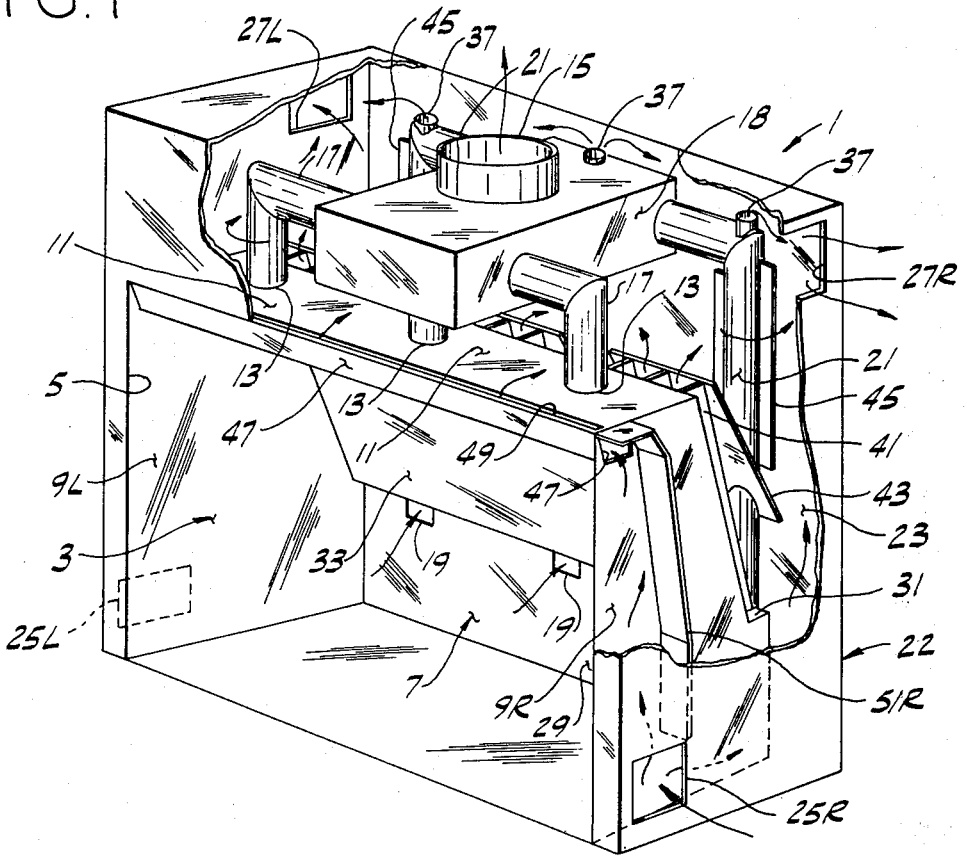
FIG. 1 is a front perspective view of a fireplace form of this invention with parts broken away to show the circulation of smoke to the chimney and the circulation of air to be heated.

Referring now to the drawings, a fireplace form of this invention, indicated in its entirety at 1, is shown to include a firebox 3 for containing a fire of burning logs (not shown) or other fuel (e.g., natural gas logs or the like). The firebox has an open front 5, a back wall 7, left and right side walls 9L and 9R, and a top wall 11. The side and back walls at least partially converge in upward direction to form a series (e.g., three) of main flue outlets 13 in top wall 11 for communication with a chimney flue 15. The flue outlets are connected to the chimney flue via flue ducts 17 and a chimney plenum box 18. It will be understood, however, that in place of the three main flue outlets 13, the firebox walls could converge to form a single throat (not shown) generally above the fire in the firebox with the throat leading directly to the chimney flue 15.

In accordance with this invention, firebox 3 has at least one auxiliary smoke aperture 19 (three of such apertures are shown) in back wall 7 intermediate the bottom of the firebox and main flue outlets 13. A respective auxiliary smoke duct 21 is sealingly secured (e.g., welded) to the outside of back wall 11 surrounding each aperture 19, these smoke ducts leading to plenum box 18 so as to duct smoke and other products of combustion from the interior of the firebox to chimney flue 15 and to thus constitute auxiliary flue means for at least partially ducting some of the smoke from the firebox. A housing, generally indicated at 22, of sheet metal or other suitable material is spaced from the outside of the firebox and defines a chamber 23 between the housing and the firebox. This housing has air inlets 25L and 25R at its lower front portions for the intake of fresh air from a room which is to be heated and air outlets 27L, 27R at the upper rear portion thereof for the discharge of heated air. Preferably, the area of the outlets is somewhat larger than the inlets. It will be understood that outlets 27L, 27R may be in communication with air ducts (not shown) for the proper distribution of heated air into a room or rooms. As air enters chamber 23, it is heated and rises within the chamber because of natural convection and is discharged via outlets 27L and 27R. The exterior of housing 22 may be covered with insulation panels (not shown) to prevent the loss of heat from the housing. The use of smoke ducts 21 appreciably increases the heated surface area of firebox 3 and thus aids in heating the air in chamber 23.

More particularly, firebox 3 may be made of heavy-gauge sheet metal or other suitable material, or may be made of cast aluminum or cast iron. When made of cast aluminum, heat transfer from the firebox to the air in chamber 23 is, of course, enhanced.

Figure 2:
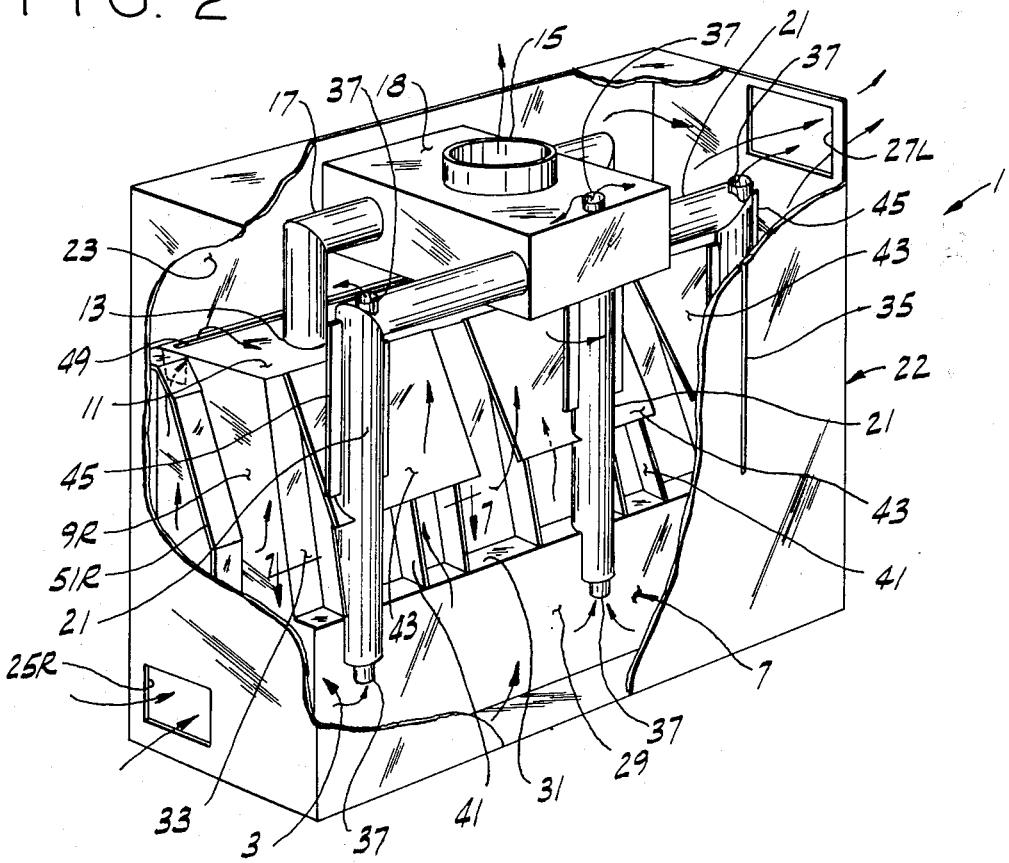
FIG. 2 is a back perspective view of a fireplace form of this invention with other parts broken away to show the flow of air as it is heated.
Figure 3:
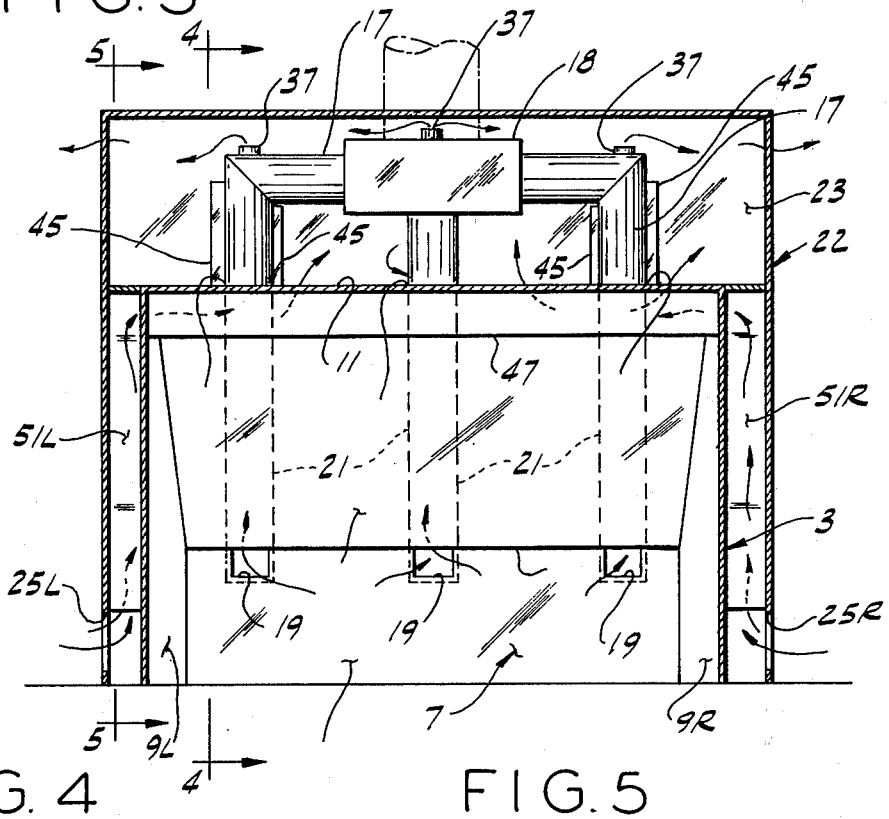
FIG. 3 is a vertical section taken on line 3—3 of FIG. 2.
Figure 4:
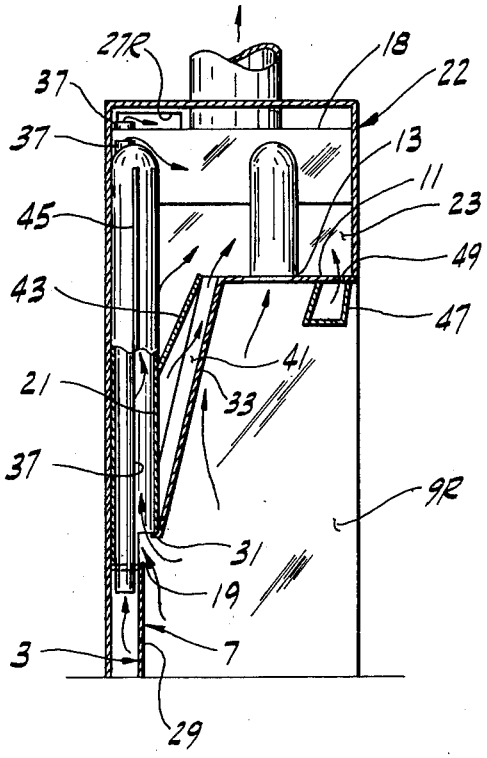
FIG. 4 is a vertical section taken on line 4—4 of FIG. 3.
Figure 5:
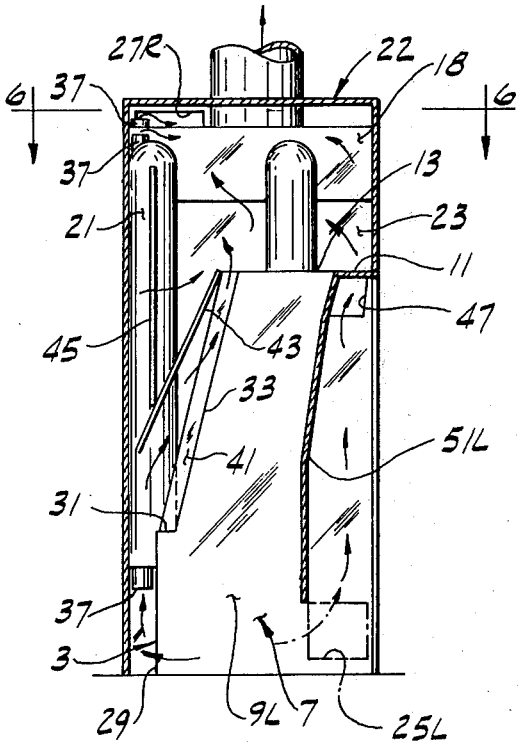
FIG. 5 is a vertical section taken on line 5—5 of FIG. 3.
Figure 6:
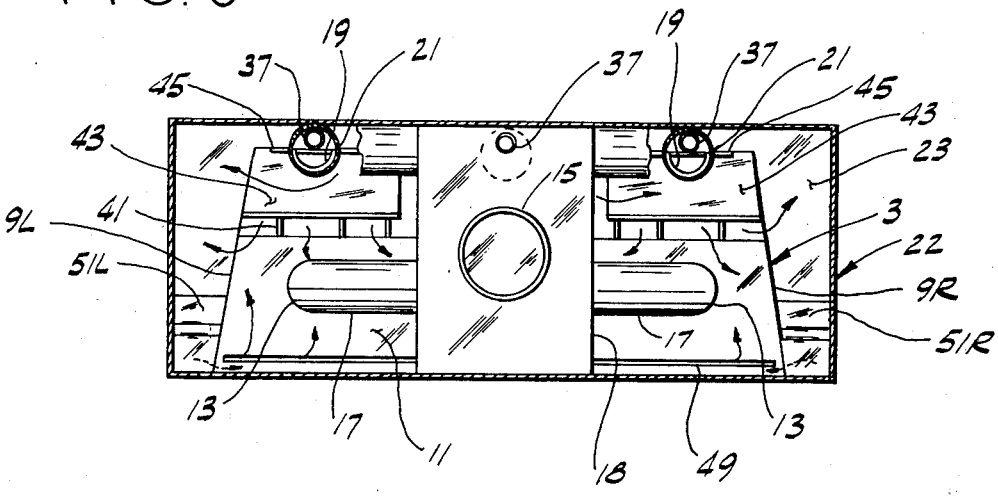
FIG. 6 is a horizontal section taken on line 6—6 of FIG. 5.
Figure 7:
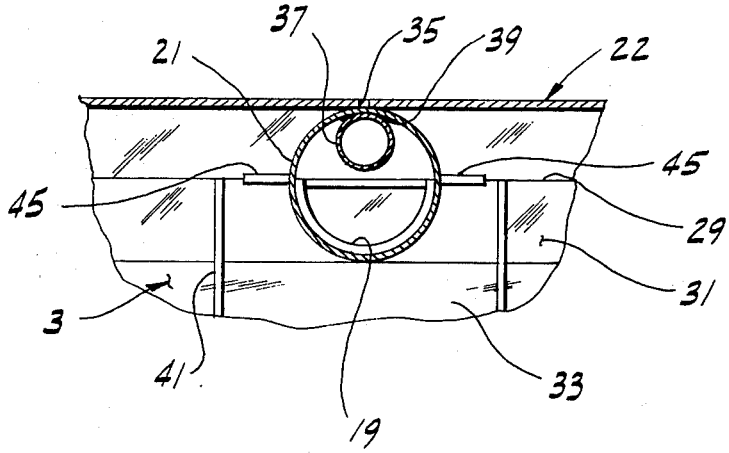
FIG. 7 is an enlarged cross-sectional view of a smoke duct taken on line 7—7 of FIG. 2.

Sidewalls 9L, 9R are shown to angle inwardly from their front edges to their rear edges so that the interior of firebox 3 is narrower at its rear than at its front. Back wall 7 has a lower, generally vertical portion 29 extending up from the floor of the firebox, a generally horizontal ledge 31 extending forward from the top of the vertical portion 29, and an inclined upper portion 33 angling upwardly and forwardly from ledge 31 to intersect top wall 11. Apertures 19 are formed in vertical wall portion 29 and in ledge 31 at the level of the ledge so as to be positioned at about the preferred level of a fire within the firebox. Auxiliary smoke ducts 21 are sealingly secured (e.g., welded) to the vertical wall portion 29 and to ledge 31 so as to surround and seal apertures 19. Preferably, a portion of the lower end of each duct 21 is removed so that the duct rests directly on ledge 33 and so that the duct surrounds both the portion of aperture 19 in wall 29 and in ledge 31. As best shown in FIGS. 2 and 7, smoke ducts 21 are secured to housing 22 in heat transfer relation. Preferably, the ducts are welded to the back wall of the housing as indicated at 35 (see FIG. 2). Thus, the housing serves as a heat transfer surface for conducting heat from the ducts and for aiding in heating air in chamber 23.

An optional inner air duct or conduit 37 may be provided within each smoke duct 21. As best shown in FIG. 2, each air duct 37 extends below its respective smoke duct 21 and its bottom end thus constitutes a fresh air intake in communication with chamber 23. The air duct extends vertically in the smoke duct and exits vertically through the smoke duct for exhausting air into the upper part of chamber 23 for discharge from outlets 27L, 27R. It will be understood that the bottom of smoke duct 21 is sealed with respect to the air duct inlet and that smoke duct 21 is sealed with respect to the air duct at the top of the air duct. As best shown in FIG. 7, air ducts 37 are of smaller cross-section than their respective smoke ducts 21 and are preferably welded to their smoke ducts as indicated at 39 to enhance the transfer of heat into the air duct from the smoke duct. As hot smoke and other products of combustion are drawn through apertures 19 and through smoke ducts 21, air ducts 37 are heated so as to heat the air therewithin. As this air is heated it rises within the ducts 37 by means of natural convection and thus causes air to continuously flow into the bottom of the air ducts to be heated and to be exhausted from the top of the air ducts. The use of these inner air ducts appreciably increases the heat transfer area of the smoke ducts and thus increases the thermal efficiency of the fireplace of this invention.

To further increase the heat transfer area of the fireplace of this invention, a series of generally vertical fins 41 are secured in heat transfer relation (e.g., welded or cast in place) to the outer face of wall portion 33 of back wall 7 of the firebox. Baffles 43 are secured to the upper ends of these fins and to smoke ducts 21 so as to channel air upwardly over wall portion 33 and over fins 41 for being heated and for being discharged toward outlets 27L, 27R. Preferably, baffles 43 are spaced from the back wall of housing 22 so as to permit air within chamber 23 to rise along smoke ducts 21 for being heated thereby. Smoke ducts 21 have fins 45 secured thereto so as to increase their heat transfer area and to thereby aid in heating the air within chamber 23.

As best shown in FIGS. 1–6, a so-called air trough or conduit 47 is provided at the upper front portion of firebox 3 for heating a portion of the fresh air drawn into chamber 23. The top of firebox 3 is, of course, one of the hottest areas of the firebox. Trough 47 is shown to extend from side to side of the firebox and to be open on its ends constituting inlets for the trough. Top wall 11 overlies the trough, but does not completely close it off. More particularly, a slot 49 extends from side to side of the firebox above the trough and constitutes an outlet for the trough. A respective baffle 51L, 51R is secured to the outside of respective walls 9L, 9R to span between firebox 3 and housing 22 so as to form a duct or conduit leading from a respective air intake 25L, 25R to a respective open end or inlet of trough 47. As air within trough 47 is heated, it rises out of slot 49 and draws more air to its inlets. In this manner at least a portion of the fresh air entering chamber 23 is drawn upwardly and guided toward the inlets to trough 47 by baffles 51L, 51R for being heated in the trough.

It will be understood that the fireplace form 1 of this invention may be a prefabricated unit adapted to be installed in a residential house or the like merely by setting it on a properly prepared base or hearth and connecting its chimney flue outlet to a flue in the house. Of course, the exact design and shape of the fireplace form in this invention may be varied considerably depending on the particular installation. It will further be understood that appropriate dampers may be incorporated in chimney flue 15, in flue ducts 17, or in smoke ducts 21.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A fireplace form comprising a firebox adapted to contain a fire of burning logs or other fuel having an open front, a back wall, and a pair of side walls at opposite sides of said back wall and extending toward said open front, said firebox having main flue outlet means generally at its top in communication with a chimney flue, said firebox having at least one aperture in its said back wall intermediate the bottom of the firebox and said main flue outlet means, said fireplace form further comprising duct means on the back side of said firebox in communication with said aperture and said chimney flue, said aperture and said duct means constituting auxiliary flue means for at least partially ducting away smoke and other products of combustion from said firebox, and means for circulating fresh air over the sides and back of said firebox and over said duct means so as to be heated and for exhausting said heated air into a room, said fresh air circulating means comprising an outer housing spaced from the outside of said firebox defining a chamber between said firebox and said outer housing, said chamber having inlet means for the intake of said fresh air and outlet means for the discharge of said heated air and further comprising a fresh air conduit disposed vertically within said duct means having an inlet at its lower end for the intake of fresh air and an outlet at its upper end for the discharge of heated air into said room via said outlet means.

2. A fireplace form as set forth in claim 1 wherein said outer housing is secured in heat transfer relation to said duct means, whereby said outer housing serves as a heat conductor for aiding in the transfer of heat from said duct means to said air being circulated in said chamber.

3. A fireplace form as set forth in claim 2 wherein said outer housing is welded to said duct means.

4. A fireplace form as set forth in claim 2 wherein said inlet means comprises a fresh air inlet at the front of said housing adjacent the bottom thereof, and wherein said outlet means comprises a warm-air outlet adjacent the top of said housing.

5. A fireplace form as set forth in claim 1 wherein said back wall of said firebox has a lower, generally vertical portion and an upper portion sloping upwardly toward the front of the firebox, said aperture being located in said back wall adjacent the intersection of said lower and said upper wall portions.

6. A fireplace form as set forth in claim 5 wherein said back wall has fins on its outer face for enhancing the transfer of heat to said air being circulated on the back side of said firebox.

7. A fireplace form as set forth in claim 6 wherein said duct means has fins on its outer surface to facilitate the transfer of heat to said air being heated within said chamber.

8. A fireplace form as set forth in claim 6 further comprising baffle means carried by said back wall for causing air in said chamber to flow upwardly on said upper sloping wall portion of said back wall and on said fins.

9. A fireplace form as set forth in claim 1 further comprising a plurality of said apertures in said back wall intermediate the bottom of said firebox and said chimney flue and a plurality of duct means, one for each aperture, in communication with its respective aperture and said chimney flue.

10. A fireplace form as set forth in claim 1 further comprising a smoke plenum box in communication with said chimney flue, said main flue outlet means and said duct means being in communication with said plenum box.

11. A fireplace form as set forth in claim 10 wherein said main flue outlet means comprises a plurality of ducts in communication with the upper portion of said firebox and with said plenum box.

12. A fireplace form as set forth in claim 1 wherein said firebox has air conduit means extending generally from side to side of the firebox adjacent the upper front portion thereof for exhausting fresh air along the top of the firebox, and wherein said fireplace form further includes means for channeling at least a portion of said air entering said air intakes to said conduit means.

13. A fireplace form as set forth in claim 12 wherein said firebox has a generally horizontal top wall, and wherein said conduit means comprises a trough below the level of said top wall extending from side to side of the firebox, said trough having an inlet at each end thereof in communication with the channeling means for the flow of air into the trough, said trough further having an outlet extending generally from side to side substantially at the level of said top wall for the discharge of heated air from the trough.

* * * * *